US005423367A

United States Patent [19]

Kataoka et al.

[11] Patent Number: 5,423,367

[45] Date of Patent: Jun. 13, 1995

[54] BLIND WITH TWO-PART ANGULAR SLATS HAVING CORD PASSING SLOTS FORMED ONLY IN ONE OF THE PARTS

[75] Inventors: Mamoru Kataoka; Hiroomi Yamanaka; Akira Sone; Kenichi Saitoh; Masaaki Yamagishi; Shimichiro Yoshida, all of Tokyo, Japan

[73] Assignee: Kabushiki Kaisha Nichibei, Tokyo, Japan

[21] Appl. No.: 158,834

[22] Filed: Nov. 24, 1993

Related U.S. Application Data

[63] Continuation of Ser. No. 25,686, Mar. 3, 1993, abandoned, which is a continuation of Ser. No. 899,233, Jun. 16, 1992, abandoned, which is a continuation of Ser. No. 775,220, Oct. 11, 1991, abandoned.

[30] Foreign Application Priority Data

Oct. 17, 1990 [JP] Japan ..... 2-108756
Oct. 19, 1990 [JP] Japan ..... 2-281108
Nov. 5, 1990 [JP] Japan ..... 2-116042

[51] Int. Cl.[6] ..... E06B 9/36
[52] U.S. Cl. ..... 160/168.1; 160/236
[58] Field of Search ..... 160/168.1, 176.1, 236, 160/172, 173, 177, 178.1, 166.1

[56] References Cited

U.S. PATENT DOCUMENTS 1,590,886 6/1926 Carella ..... 160/176.1
1,616,385 2/1927 Metcalf ..... 160/236 X
2,053,220 9/1936 Howard ..... 160/176.1 X
2,110,145 3/1938 Loehr ..... 160/176.1 X
2,155,985 4/1939 Waterman ..... 160/236 X
2,220,064 11/1940 Clark ..... 160/176.1 X
2,315,605 4/1943 Ehrenfeld ..... 160/236 X
2,318,525 5/1943 Renton ..... 160/236 X
2,325,003 7/1943 Beckwith et al. ..... 160/236 X
2,410,549 11/1946 Olson ..... 160/176.1 X
2,633,191 3/1953 Curtis ..... 160/176.1
3,170,505 2/1965 Lorentzen et al. ..... 160/176.1
4,799,526 1/1989 Reeves ..... 160/236 X

*Primary Examiner*—David M. Purol
*Attorney, Agent, or Firm*—Anderson Kill Olick & Oshinsky

[57] ABSTRACT

A blind includes a plurality of horizontal angle-shaped slats supported by ladder-shaped supporting cords, which extend vertically from a bottom of a head box of the blind, and lifting cords, which extend from the head box through cord passing slots in the slats to a bottom rail of the blind, for raising and lowering the slats. Each of the slats has a first, porous and semi-light-transmitting part extending from an apex portion of the slat to one side edge of the slat and a second, non-porous and non-light-transmitting part extending from the apex portion of the slat to the another side edge of the slat. The cord passing slots are formed either in first parts of the plurality of slats or in the second parts of the plurality of slats, and extend from apex portions of respective slats to one edges of the slats or to another edges of the slats, respectively.

4 Claims, 8 Drawing Sheets

BLIND WITH TWO-PART ANGULAR SLATS HAVING CORD PASSING SLOTS FORMED ONLY IN ONE OF THE PARTS

This is a continuation of application Ser. No. 08/025,686, now abandoned filed Mar. 3, 1993, which is a continuation of application Ser. No. 07/899,233, filed Jun. 16, 1992, now abandoned which in turn is a continuation of application Ser. No. 07/775,220, filed Oct. 11, 1991, now abandoned.

BACKGROUND OF THE INVENTION

1. Field of the Invention

The present invention relates to a blind which includes a head box, ladder-shaped supporting cords vertically extending from a bottom of said head box, a plurality of horizontal slats supported by said ladder-shaped supporting cords in vertically spaced relation to each other, a bottom rail disposed at the bottom of said plurality of horizontal slats, and lifting cords for raising or lowering said plurality of horizontal slats, each lifting cord vertically extending from the bottom of the head box through cord passing holes formed in the respective slats and being connected, at its lower end, to said bottom rail, wherein the slats are arranged to be raised or lowered by means of the lifting cords and to be tilted by means of said ladder-shaped supporting cords in order to adjust light-shielding effect of the blind.

2. Description of the Prior Art

Recently, in the field of the blind of this kind, there has been developed a blind in which each of the slats has an angle-shape in section and the cord passing hole is formed at an apex portion of said angle-shape. FIGS. 1 and 2 illustrates an example of the blind of this kind. In FIGS. 1 and 2, 1 designates a slat having an angle-shape in section, and 2 designates a cord passing hole for passing a lifting cord therethrough which is formed at an apex portion of said angle-shape. As shown in FIG. 3, a plurality of such slats 1 are supported by means of ladder-shaped supporting cords 4 which vertically extend from a bottom of a head box 3 downwardly. Each of lifting cords 5 for raising or lowering the slats comes out from a center position of the bottom of the head box 3 and extends through the cord passing holes 2 formed in the respective slats 1. The lifting cord 5 is connected, at its lower end, to a bottom rail 6 disposed at the bottom of the plurality of slats 1. These slats 1 are arranged to be raised or lowered by pulling the lifting cords 5 into or out of the head box 3 and to be tilted by relatively moving front and rear cord portions of the ladder-shaped supporting cords in vertical direction, thereby adjusting light-shielding effect of the blind.

In the blind including the slats having the angle-shape in section, when the slats are tilted by the ladder-shaped supporting cords, as explained above, the inner edges of the cord passing holes formed in the respective slats come into contact with the lifting cords, thereby hindering the tilting action of the slats so that it is difficult to tilt the slats to the desired vertical positions.

In the conventional blind of this type, slats having arcuate-shape in section have been usually used. The inventors have recently developed a new type of blind which includes arcuate-shaped slats, each of which is formed with many small pores, thereby forming a semi-light-transmitting slat (which is called as a "punched slat"). The blind using the punched slats of this type has such characteristic feature that when the blind is completely closed by tilting the slats to their vertical positions, the outside can be seen from the inside of a room while shielding a sun light, that is very convenient in practical use and this blind presents a superior external appearance. This blind has a good reputation for such characteristic feature, but has such defect that when the outside becomes dark, while the inside of the room is light, it is difficult to completely keep the inside of the room out of sight from the outside. This blind has a further defect in that a cord passing a hole for passing a lifting cord is relatively large and it is difficult to completely avoid the leakage of light through the cord passing hole.

SUMMARY OF THE INVENTION

It is an object of the present invention to provide a blind using slats of angle-shape in section, in which the slats can be fully tilted to the vertical positions, without being subjected to the hindering action of the lifting cords coming into contact with the edges of the cord passing holes formed in the slats.

It is another object of the present invention to provide a blind which avoids the defects of the blind using the semi-light-transmitting punched slats, which the inventors have previously developed, as described above and to provide a blind which can be changed to a semi-light-transmitting blind and a non-light-transmitting blind.

It is another object of the present invention to provide a blind which can completely avoid leakage of light through cord passing holes when the blind is completely closed.

It is a further object of the present invention to provide a horizontal blind in which slats having angle-shape in section are used, which is arranged to enable folding of the slats to the position where the slats come into intimate contact with each other and which enables to fully open the blind slats.

In accordance with the present invention, there is provided, a blind including a head box, ladder-shaped supporting cords vertically extending from a bottom of said head box, a plurality of horizontal slats supported by said supporting cords in vertically spaced relation to each other, a bottom rail disposed at the bottom of said plurality of horizontal slats and lifting cords for raising or lowering the plurality of slats, each lifting cord vertically extending from the bottom of the head box through cord passing holes formed in the respective slats and being connected, at its lower end, to said bottom rail, wherein the slats are arranged to be raised or lowered by means of said lifting cords and to be tilted by means of said ladder-shaped supporting cords in order to adjust light-shielding effect of the blind, characterized in that each Of said slats has an angle-shape in section; each of said cord passing holes is formed as a slot which extends from an apex portion of said angle-shape toward one side edge of said slat; and the position of said lifting cord coming out from the bottom of the head box is located aside of a center line of the bottom of the head box toward said one side edge.

Further, in accordance with the present invention, there is provided a blind of this type, characterized in that each of said slats has an angle-shape in section; each slat has a first part extending from an apex portion of said angle-shape to one side edge of said slat and a second part extending from the apex portion of said angle-shape to the other, side edge of the slat, said first part being porous and semi-light-transmitting, said second part being non-porous and non-light-transmitting; and the cord passing holes are formed at the apex portion of said slat.

In accordance with an embodiment of the invention, there is provided a blind wherein said cord passing hole is formed as a slot which extends from the apex portion of said angle-shape to the first portion of the slat at substantially right angle to the slat.

In accordance with another embodiment of the invention, there is provided a blind wherein said cord passing hole is formed as a slot which extends from the apex portion of said angle-shape to the second part of the slat at substantially right angle to the slat.

In accordance a further embodiment of the invention, there is provided a blind wherein the position of the lifting cord coming out from the bottom of the head box is located aside of a center line of the bottom of the head box toward the same side as that of the slat where said slot is formed.

Further in accordance with the present invention there is provided a horizontal blind including a plurality of horizontal slats supported in vertically spaced relation to each other by means of ladder-shaped supporting cords, each having a front vertical cord portion, a rear vertical cord portion and horizontal cord portions connecting said front and rear vertical cord portions at vertically spaced positions, characterized in that each of the slats has an angle-shape in section including an apex and two side parts slanting from the apex to both side edges of the slat, and each of the horizontal portions of the ladder-shaped supporting cords has a length which is substantially equal to a sum of widths of the two side parts from the apex to the both side edges of the slat.

DETAILED DESCRIPTION OF THE PREFERRED EMBODIMENT

Figure 1:
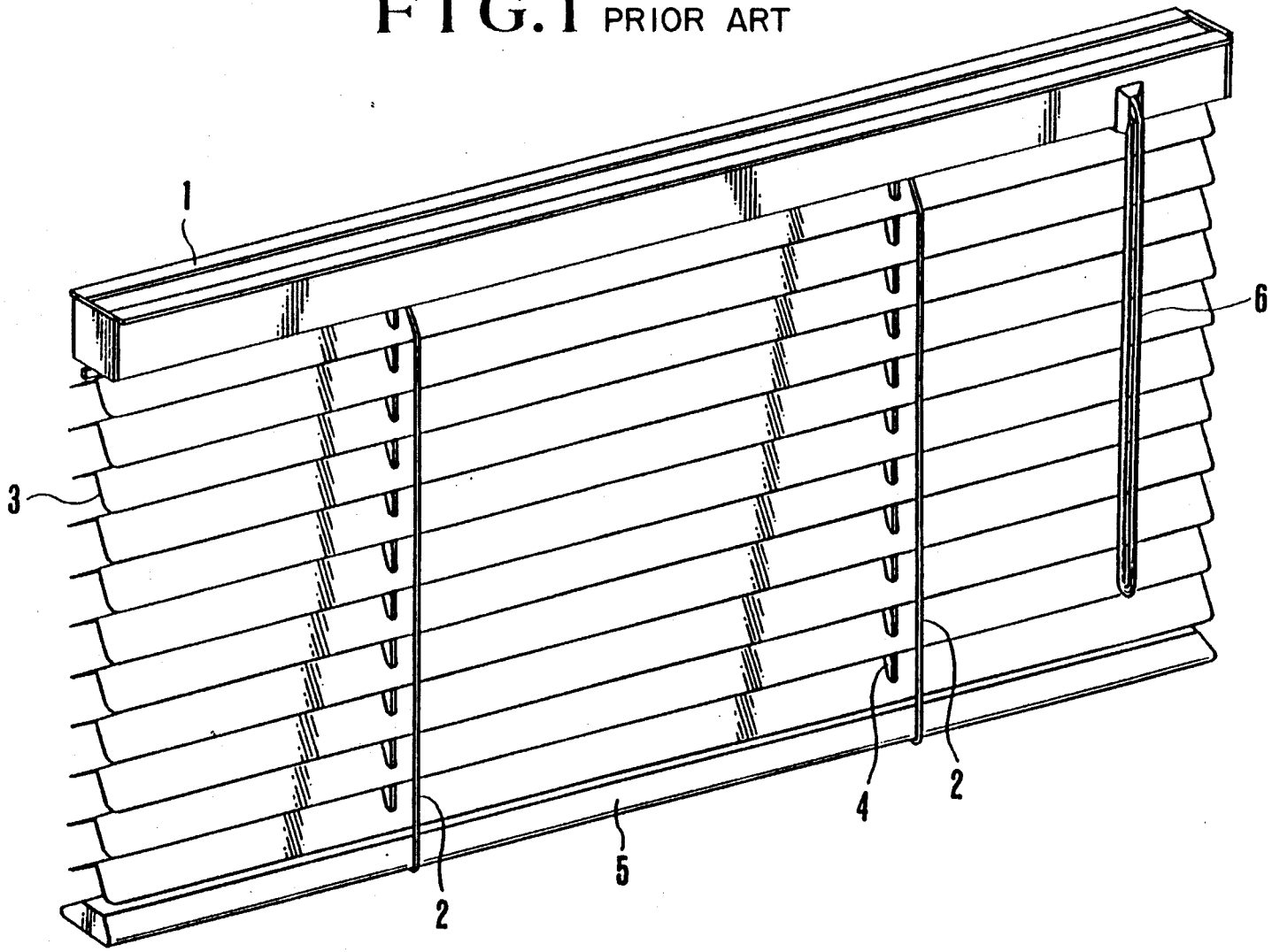
FIG. 1 PRIOR ART
FIG. 1 is a perspective view showing a blind according to a prior art.

Now the explanation will be given to the preferred embodiments of the invention as illustrated in the drawings.

FIG. 1 illustrates the horizontal blind. The blind shown in the drawings includes a head box 1, ladder-shaped supporting cords 2, a plurality of horizontal slats 3 supported in vertically spaced relation by means of said supporting cords, lifting cords 4 for raising or lowering the slats, a bottom rail 5 arranged at the bottom of the plurality of horizontal slats and an operating cord 6 for effecting raising or lowering operation as well as slat tilting operation.

Figure 2:
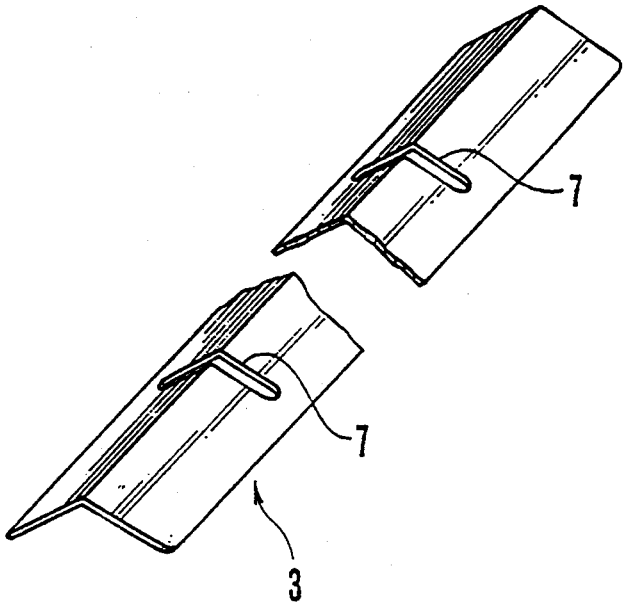
PRIOR ART FIG.2
FIG. 2 is a perspective view showing a slat used in the blind shown in FIG. 1.

As shown in FIG. 2, a cord passing hole 7 for passing a lifting cord therethrough is formed at an apex of said angle-shape.

Figure 3:
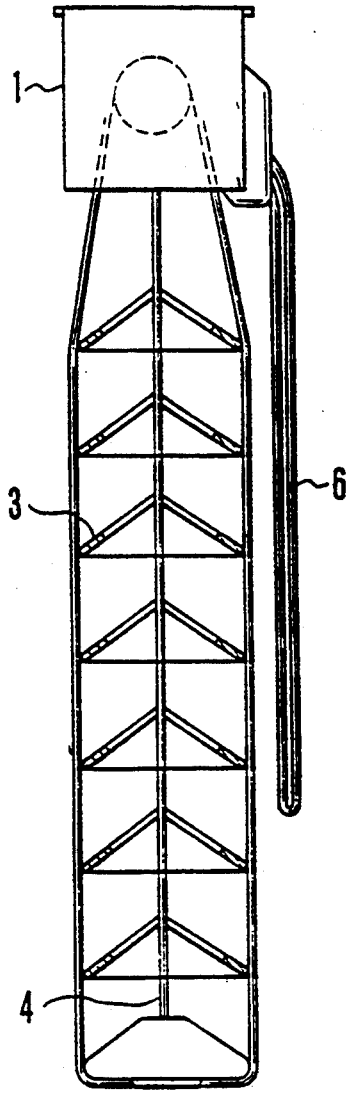
PRIOR ART FIG.3
FIG. 3 is a side view of the blind shown in FIG. 1.

As shown in FIG. 3, a plurality of such slats 3 are supported by means of ladder-shaped supporting cords 2 which vertically extend from a bottom of a head box 1 downwardly. Each of lifting cords 4 for raising or lowering the slats comes out from a center position of the bottom of the head box 1 and extends through the cord passing holes 7 formed in the respective slats 3. The lifting cord 4 is connected, at its lower end, to a bottom rail 5 disposed at the bottom of the plurality of slats 3. These slats 3 are arranged to be raised or lowered by pulling the lifting cords 4 into or out of the head box 1 and to be tilted by relatively moving front and rear cord portions of the ladder-shaped supporting cords 2 in vertical direction, thereby adjusting light-shielding effect of the blind.

In the blind including the slats having the angle-shape in section, when the slats are tilted by the ladder-shaped supporting cords, as explained above, the inner edges of the cord passing holes 7 formed in the respective slats come into contact with the lifting cords 4 thereby hindering the tilting action of the slats, so that it is difficult to tilt the slats to the desired vertical positions. In order to eliminate such defect, the present invention provides a blind in which each of said cord passing holes 7 is formed as a slot which extends from an apex portion of said angle-shape toward one side edge of said slat and the position of said lifting cords coming out from the bottom of said head box 1 is located aside of a center line of said bottom of the head box 1 toward said one side edge.

According to this construction, the cord passing hole is formed a slot which extends from an apex portion of the angle-shape of the slat toward one side edge of the slat and the position of each lifting cord coming out from the bottom of the head box is located aside of the center line of the head box toward said one side edge. Accordingly, when the slat is tilted to the position where a side of the slat opposite to that of the slat comes to a vertical state, the lifting cords enter into the slots so that no hindering effect can occur by the lifting cords coming into contact with the inner edges of the slats. Thus it is possible to tilt the slats to their completely vertical positions. Furthermore, the cord passing hole is formed from the apex portion of the slat toward only one side thereof, so that leakage of a light through the cord passing holes at the vertically tilted state of the slats can be completely avoided.

Figure 4:
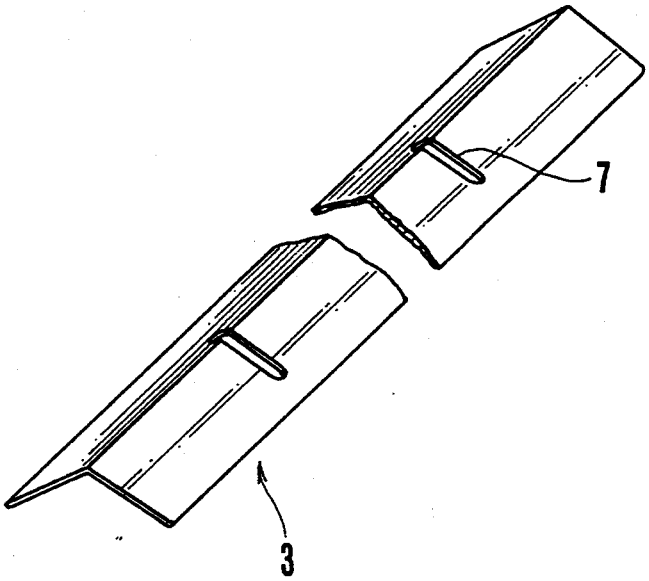
FIG. 4 is a perspective view of a slat according to an embodiment of the present invention.
Figure 5:
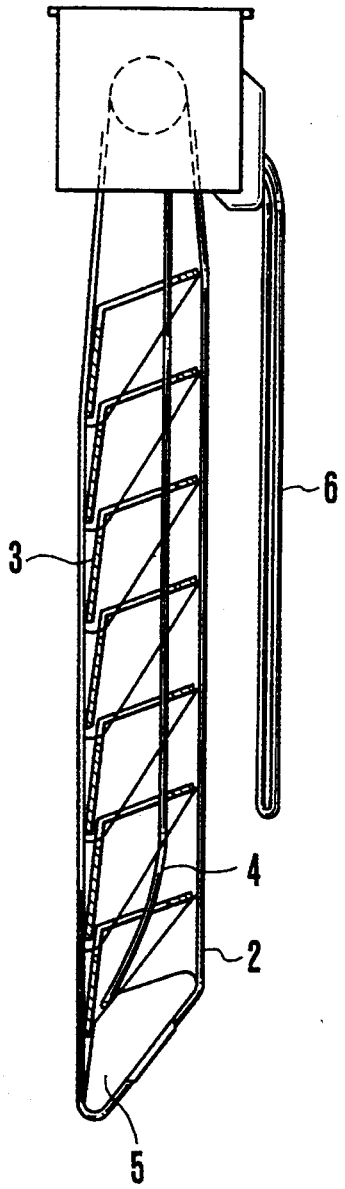
FIG. 5 is a side view of the blind in which the slats shown in FIG. 4 are used.

Such embodiment is illustrated in FIGS. 4 and 5.

The cord passing hole 7 is formed as a slot which extends from the apex portion of the angle-shaped slat 3 toward one side edge of the slot. The position of the lifting cord 4 coming out from the bottom of the head box is located aside of the center line of the bottom of the head box toward one side edge of the slat, as shown in FIG. 5. Accordingly, when the slat is tilted in the direction opposite to the side where the slot is formed, the slat can be tilted, without being subjected to hindrance caused by the cord coming into contact with the inner edge of the slot. Furthermore, substantially no hole is formed in the side of the slat opposite to the side where the slot is formed, so that the leakage of light through the cord passing is avoided.

Accordingly, the slats can be tilted to their completely light-shielding state and the leakage of light through the cord passing holes can be completely avoided.

Figure 6:
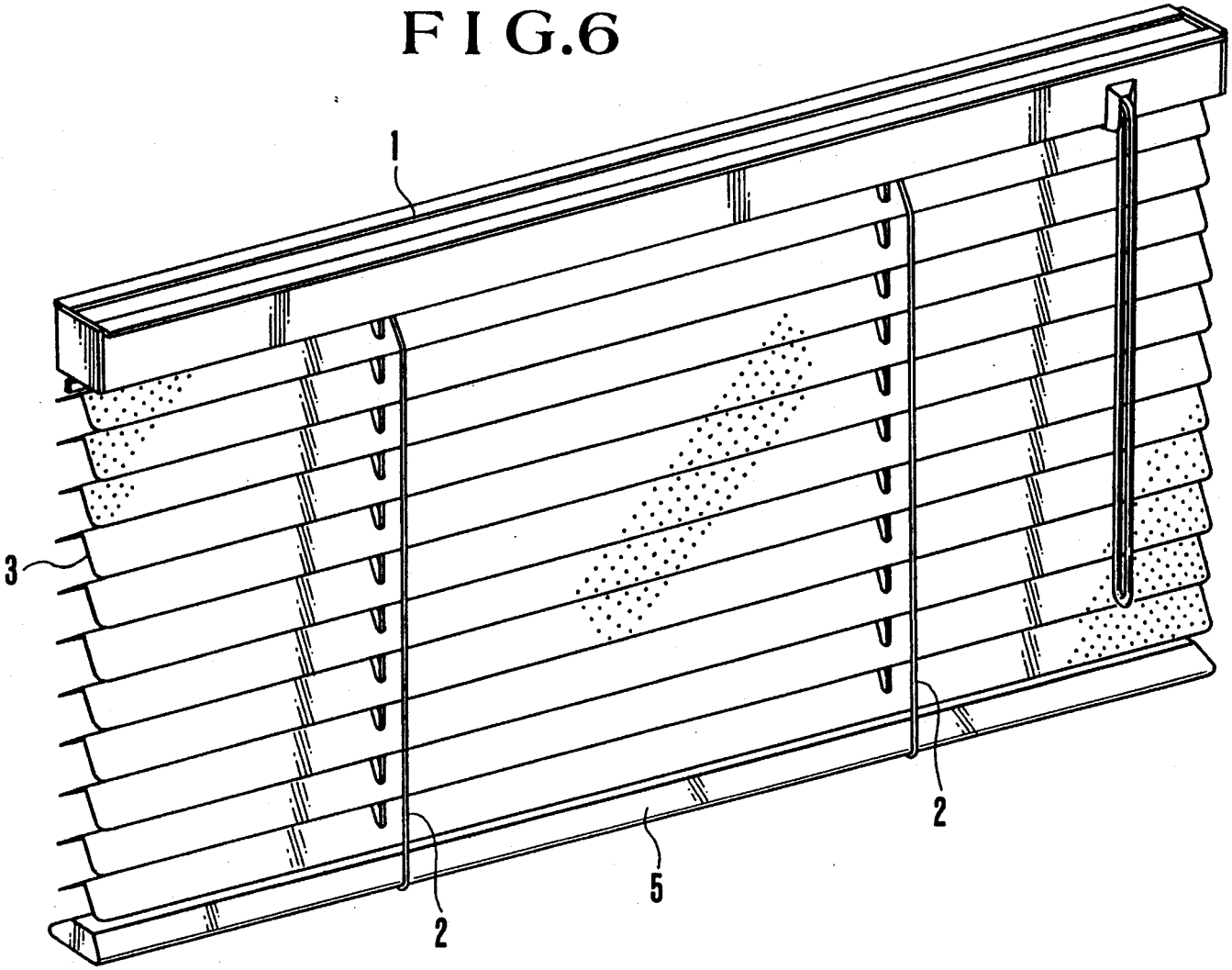
FIG. 6 is a perspective view showing another embodiment of the present invention.

FIG. 6 illustrates another embodiment of the blind according to the present invention. The embodiment shown in FIG. 6 includes same parts as those shown in FIG. 1. In the constructions of the illustrated blind, an actuator rod (not shown) arranged in the head box is rotated by the operating cord 6, whereby the slats 3 are raised or lowered through the lifting cords 4 and the slats 3 are tilted to one or other direction through the ladder-shaped supporting cords 2. The operating mechanism is well known in the art of the blind of this kind and, therefore, the detailed description thereof is omitted.

Figure 8:
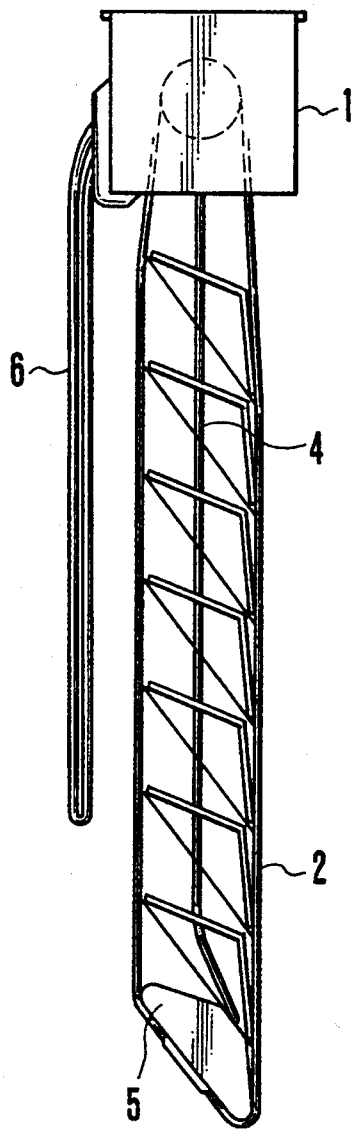
FIG. 8 is a side view of the blind shown in FIG. 6.
Figure 7:
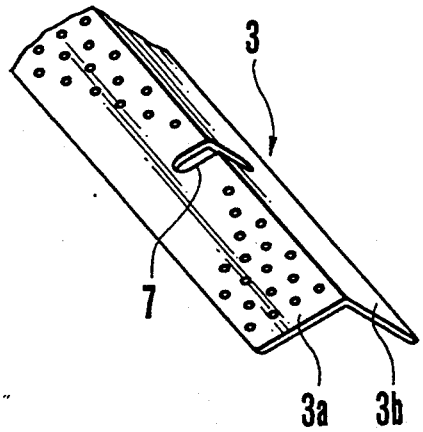
FIG. 7 is a perspective view showing the slat according to another embodiment of the present invention.

The slat 3 has an angle-shape in section, as shown in FIG. 7, and has a first part 3*a* extending from an apex portion of said angle-shape to one side edge of the slat, said first part being porous and semi-light-transmitting, and a second part 3*b* extending from the apex portion of said angle shape to the other side edge of the slat, said second part being non-porous and non-light-transmitting. The cord passing hole 7 is formed in the apex portion of the slat. The tilted state of the slat is shown in FIG. 8.

In this construction, when the blind is operated to the position where the first parts 3*a* of the slats 3 come to the vertical positions, the semi-light-transmitting portions 3*a* are aligned in the vertical position at the closed state of the blind, so that semi-light-transmitting blind is formed in the same manner as in the above-mentioned blind using the punched slats. On the other hand, when the blind is operated to the position where the second parts 3*b* of the slats come to the vertical positions, the non-light-transmitting portions are aligned in-the vertical position at the closed state of the blind, so that the sight from the outside is completley shielded.

That is, this blind is arranged to be changed to the semi-light-transmiting state or the non-light-transmitting state by rotating the slats in one or the other direction.

In this blind, the cord passing hole 7 is relatively large, so that the leakage of the light through the cord passing holes occurs at the blind closed state.

Figure 9:
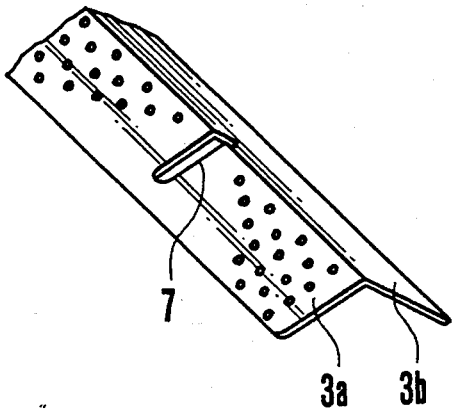
FIG. 9 is a perspective view showing a slat according to another embodiment of the present invention.
Figure 10:
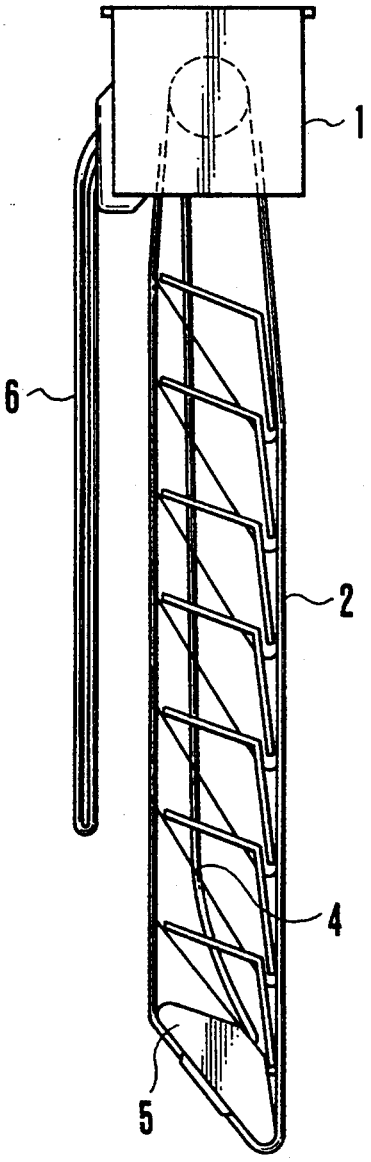
FIG. 10 is a side view of the blind in which the slats shown in FIG. 9 are used.

In order to eliminate such defect, the present invention provides the blind of the above type, in which the cord passing hole 7 is formed as a slot which extends from the apex portion of the angle-shape to the first part 3*a* of the slat at substantially right angle thereto. Such embodiment is shown in FIG. 9.

In this embodiment, there is substantially no portion of the cord passing holes 7 in the second parts of the slats, so that when the slats are rotated to the positions where the second parts 3*b* are vertically aligned, the leakage of light through the cord passing holes can be avoided.

Figure 13:
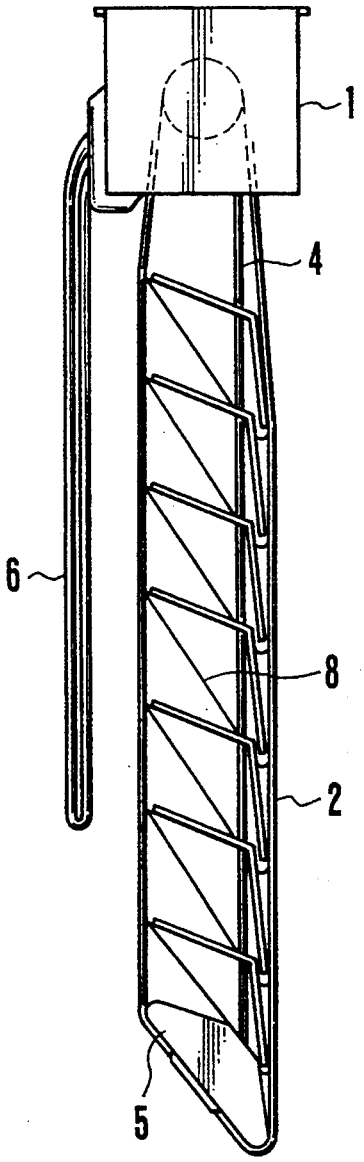
FIG. 13 is a side view of the blind in which the slats shown in FIG. 12 are used.

The slat having the angle-shape in section is superior in its light-shielding effect to the conventional arcuate-shape in section at the completely closed state of the blind. In fact, the blind having the conventional slats of the arcuate-shape in section cannot be closed to the position where the adjacent upper and lower slats come into direct contact, at their side edges with each other, in the completely closed state of the blind, and some clearance necessarily exists between the lower side edge of the upper slat and the upper side edge of the lower slat. On the other hand, the blind having the slats of the angle-shape in section can be closed to the position where the adjacent upper and lower slats come into such relation that the side edge of the upper slat directly contacts with the apex portion of the lower slat, with an intermediate cord portion 8 (shown in FIG. 13) of the ladder-shape supporting cord being positioned between said adjacent slats. Thus the leakage of light through the gap between the upper and lower slats can be avoided.

However, in the case where the cord passing hole 7 is located at the center position of the slat, when the blind is operated to the completely closed position, the cord passing hole 7 comes to the overlapping position of the upper and lower slats to form the gap between the slats, with the result that the leakage of light occurs through such gap. In order to completely avoid the leakage of light, the present invention provides a construction of the blind in which the cord passing hole is formed in the semi-light-transmitting part which extends from the apex portion of the angle-shape to one side edge of the slat. According to this construction, when the blind is completely closed, the core passing hole is concealed by the slat located thereon to avoid the leakage of light, so that the complete light-shielding effect is obtained.

In the case where the slat is tilted in the opposite direction, the cord passing hole is exposed to large extent, so that the light-shielding effect can be obtained only when the slats are rotated in one direction. However, the cord passing hole is formed at the side of the semi-light-transmitting part and, therefore, the leakage of light through the cord passing hole does not offer any significant problem.

Thus it is possible to effect fine adjustment of light at the blind closed state, between the completely light shielding state at the non-light-intermitting side of the slat and the semi light shielding state at the semi-light-transmitting side of the slat.

If the position of the lifting cord 4 coming out from the bottom of the head box 1 is located aside of the center line of the bottom of the head box toward the side of the slat where the slot is formed, that is, at the same side as that of the part 3*a*, the slats can be tilted to the state where the second parts 3*b* come to completely vertical positions. Thus the shielding effect of the blind can be further improved.

Figure 11:
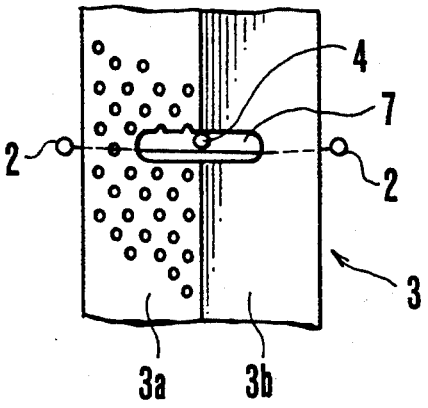
FIG. 11 is a plan view of the slat according to a further embodiment of the present invention.
Figure 12:
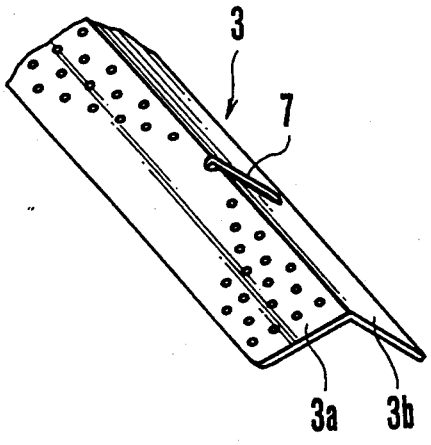
FIG. 12 is a perspective view showing a slat according to another embodiment of the invention.

In the above-described embodiment, the openings of the pores appear at the edge of the lifting cord passing hole 7, as shown in FIG. 11, that is, the edge of the cord passing hole 7 forms a serrated edge. If such serrated edge is formed, the lifting cord and/or the intermediate cord portion 8 of the ladder-shaped supporting cord may be cut by the contact with such serrated edge. In order to avoid such defect, the present invention provides the blind of this type in which the cord passing hole is formed as a slot which extends from the edge portion of the angle-shape of the second part 3*b* at substantially right angle thereto. Such embodiment is shown in FIG. 12.

According to this embodiment, the cord passing hole 7 is formed as a slot which extends from the apex portion of the slat to the non-light-transmitting part 3*b*, so that the cord passing hole is concealed by the slat located upside thereof, whereby the light leakage is avoided. That is, the homogeneous light transmitting property throughout the semi-light-transmitting parts is obtained. (However, in the case where the slats are rotated in the opposite direction, the cord passing holes are exposed to large extent and, therefore, the direction of rotation to completely shield the leakage of light through the cord passing holes is limited to one direction). In the case where the cord passing hole is formed at the center portion of the slat, as in the conventional blind, some of the pores may appear at the edge of the cord passing hole and the lifting cord and/or the intermediate cord portion of the ladder-shaped supporting cord are subjected to wearing or cutting action by the serrated edge of the cord passing hole until the lifting cord and/or the intermediate cord portion of the supporting cord become cut. As compared thereto, in the case where the cord passing hole is formed only in the non-light-transmitting side of the slat, no serrated edge is formed, so that the cutting of the cord is avoided.

In this case, it is preferred that the position of the lifting cord 4 coming out from the bottom of the head box 1 be located aside of the center of the head box toward that of the second part 3*b* of the slat, whereby the tilting of the slat can be effected in easier manner.

Figure 14A:
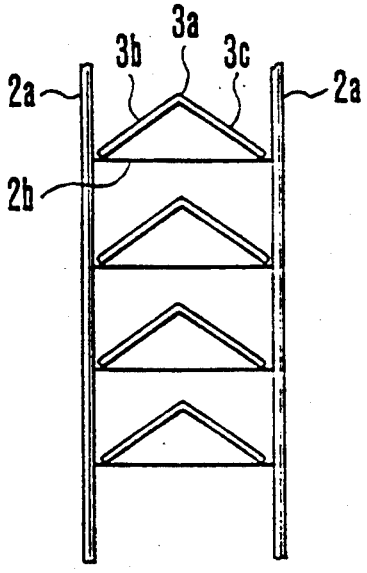
PRIOR ART FIG.14A
FIGS. 14A and 14B illustrate a ladder-shaped supporting cord according to a prior art.
Figure 14B:
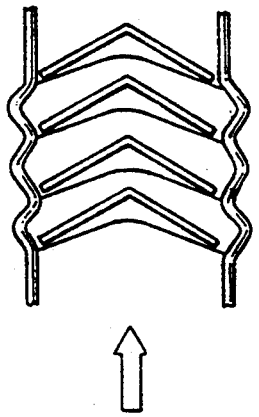
PRIOR ART FIG.14B
Figure 15A:
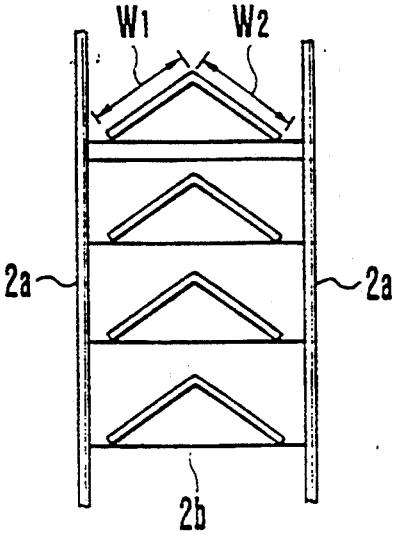
FIGS. 15A and 15B illustrate a ladder-shaped supporting cord according to the present invention.

FIGS. 14A and 15A illustrate the ladder-shaped supporting cord. As shown in these figures, the ladder-shaped supporting cord 2 includes front and rear vertical cord portions 2*a* and horizontal cord portions 2*b* which connect the vertical cord portions 2*a* at vertically spaced positions. Each slat 3 is supported on each of the horizontal cord portions. The slat 3 has an angle-shape in section, as shown in FIG. 14A, and includes an apex 3*a* and both side portions 3*b* and 3*c* slanting from the apex to the both side edges of the slat.

In the horizontal blind in which the slats 3 of the angle-shape in section are used, if the length of the ladder-shaped supporting cord 2*b* is made substantially equal to the width of the slat, as shown in FIG. 14A, when the slats have been folded upwardly, the apex of the slat comes into engagement with the horizontal cord portion of the supporting cord of the upper slat, thereby hindering the slats from being completely folded together until the slats come into intimate contact with each other.

Figure 15B:
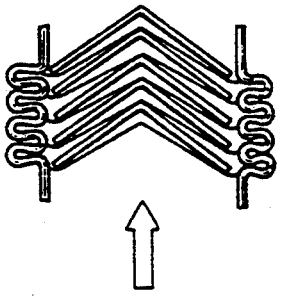

In order to avoid such defect, according to the present invention, the length of the horizontal portion of the ladder-shaped supporting cord is made to be substantially equal to a sum of widths W1 and W2 of the two slanting side parts 3*b* and 3*c* from the apex 3*a* to the both side edges of the slat, as shown in FIG. 15A. According to such arrangement, when the slats have been folded upwardly, the apex of each slat acts to upwardly push the horizontal cord portion of the upper slat, as shown in FIG. 15B, thereby folding the slats until the slats come into intimate contact with each other.

What is claimed is:

1. A blind, comprising:

a head box having a bottom;

a plurality of ladder-shaped supporting cords extending vertically from said bottom of said head box;

a plurality of horizontal angle-shaped slats supported by said ladder-shaped supporting cords in a predetermined vertically spaced relationship to each other;

a bottom rail disposed at a bottom of said plurality of horizontal angle-shaped slats;

a plurality of lifting cords for raising and lowering said plurality of horizontal angle-shaped slats, each of said plurality of lifting cords extending vertically between said bottom of said head box and said bottom rail and through respective cord passing slots formed in each of said plurality of horizontal angle-shaped slats, wherein each of said horizontal angle-shaped slats has a first, porous and semi-light-transmitting part extending from an apex of the slat to one side edge of the slat, and a second, non-porous and non-light-transmitting part extending from said apex to another side edge of the slat;

wherein cord passing slots of each horizontal angle-shaped slat is formed only in the second part thereof extends from the apex of the horizontal angle-shaped slat at a substantially right angle to said apex and toward said another, whereby leakage of light through the cord passing slots is avoided in a vertical closed position of the blind; and wherein a vertical spacing between adjacent horizontal angle-shaped slats is less than a width of a part of a horizontal angle-shaped slat whereby penetration of light from outside is completely prevented.

2. A blind according to claim 1, wherein each of said lifting cords extends aside of a center line of the bottom of said head box and toward an end of the cord passing slots of said slats which is remote from said apex portion.

3. A blind according to claim 1, wherein each of said ladder-shaped cords has a horizontal portion having a length which is substantially equal to a sum of width of said first and second parts.

4. A blind, comprising:

a head box having a bottom;

a plurality of ladder-shaped supporting cords extending vertically from said bottom of said head box;

a plurality of horizontal angle-shaped slats supported by said ladder-shaped supporting cords in a predetermined vertically spaced relationship to each other;

a bottom rail disposed at a bottom of said plurality of horizontal angle-shaped slats;

a plurality of lifting cords for raising and lowering said plurality of horizontal angle-shaped slats, each of said plurality of lifting cords extending vertically between said bottom of said head box and said bottom rail and through respective cord passing slots formed in each of said plurality of horizontal angle-shaped slats, cord passing slots of each horizontal angle-shaped slat being formed only in one side thereof and extending from an apex of respective horizontal angle-shaped slat at a substantially right angle to said apex and toward an edge of said one side, whereby leakage of light through the cord passing slots is avoided in a vertical closed position of the blind;

wherein a vertical spacing between adjacent horizontal angle-shaped slats is less than a width of a side of a horizontal angle-shaped slat, whereby penetration of light from outside is completely prevented; and wherein each of said plurality of lifting cords extends aside of a center line of said bottom of said head box and toward said edge of said one side to prevent engagement of apex edges of the cord-passing slots with the respective lifting cords during tilting of the slats to the vertical closed position.

* * * * *